US007183339B2

(12) United States Patent
Shen et al.

(10) Patent No.: US 7,183,339 B2
(45) Date of Patent: Feb. 27, 2007

(54) METHOD FOR MAKING DIMENSIONALLY STABLE COMPOSITE PRODUCTS FROM LIGNOCELLULOSES

(76) Inventors: Kuo C. Shen, 2118 Radford Court, Ottawa, Ontario (CA) K1J 8K1; Kenneth C. Shen, 2118 Radford Court, Ottawa, Ontario (CA) K1J 8K1

( * ) Notice: Subject to any disclaimer, the term of this patent is extended or adjusted under 35 U.S.C. 154(b) by 47 days.

(21) Appl. No.: 10/978,358

(22) Filed: Nov. 2, 2004

(65) Prior Publication Data

US 2006/0091577 A1 May 4, 2006

(51) Int. Cl.
*B27N 3/12* (2006.01)

(52) U.S. Cl. ..... 524/13; 264/109; 264/124

(58) Field of Classification Search ..... None
See application file for complete search history.

(56) References Cited

U.S. PATENT DOCUMENTS 3,790,417 A * 2/1974 Paterson et al. ..... 156/62.8
4,357,194 A * 11/1982 Stofko ..... 156/308.6
4,461,648 A * 7/1984 Foody ..... 127/37
4,551,433 A * 11/1985 DeBoer ..... 162/16
4,610,900 A * 9/1986 Nishibori ..... 428/15
5,017,319 A * 5/1991 Shen ..... 264/124
6,243,931 B1 * 6/2001 Linville et al. ..... 27/14
6,652,789 B1 * 11/2003 Pearson ..... 264/112

* cited by examiner

*Primary Examiner*—Mary Lynn Theisen
(74) *Attorney, Agent, or Firm*—Steptoe & Johnson LLP

(57) ABSTRACT

This invention relates to a process for making dimensionally stable reconstituted composite products from lignocellulosic material. By treating lignocellulose with high pressure steam to decompose and hydrolyze the hemicellulose, cellulose and lignin fractions of the lignocellulose and using those decomposition products as both a bonding and bulking agent, it converts, under heat and pressure in a molding operation, the treated lignocellulose into molded composite products such as panel boards and molded articles. The composite products thus produced possess good physical and mechanical properties. Specifically, the dimensional stability in terms of the thickness swelling and linear expansion of panel boards such as fiberboards and particleboard, can be minimized to very low levels when the panel boards are made in high density. The adhesive bond developed from thermosetting of the decomposition products of hemicellulose, cellulose and lignin is strong and stable, and resistant to boiling water and acid hydrolysis, and is free of formaldehyde emissions. Thus, the reconstituted panel boards and molded products are suitable for exterior and particularly for indoor applications. The absence of free formaldehyde emissions makes the product very suitable for interior applications. The manufacturing cost for the reconstituted products is significantly lower in comparison to the conventional process because expensive synthetic resin is not used.

14 Claims, 1 Drawing Sheet

Figure 1. Board Density vs. Internal Bond
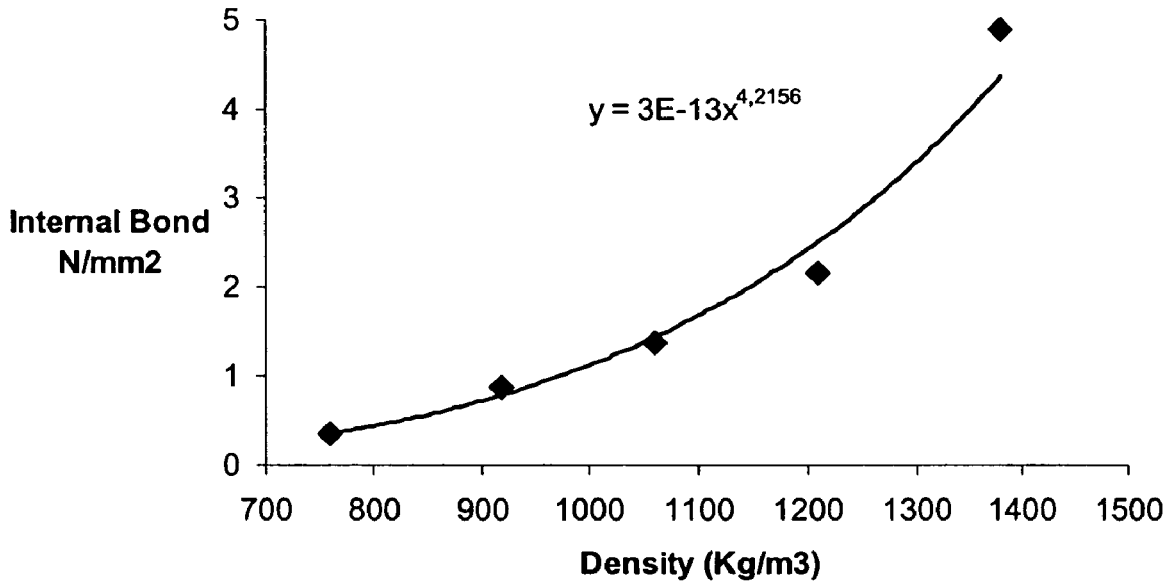

METHOD FOR MAKING DIMENSIONALLY STABLE COMPOSITE PRODUCTS FROM LIGNOCELLULOSES

BACKGROUND OF THE INVENTION

The present invention relates to a process of making highly dimensionally stable composite products from lignocellulosic material without the addition of synthetic resin binders and products produced therefrom where the final product is similar to conventional high density products made with high resin content.

The technologies of manufacturing wood-based composite products have not changed significantly since their original inception about 80 years ago (Masonite wet process for manufacturing thin hardboard). Essentially, the processes involve reducing wood into fibres, particles, chips, strands etc, adding synthetic resins and then consolidating them under heat and pressure to produce a composite product. Their physical properties, and therefore their end applications, are determined in large part, by the quantity and nature of the synthetic resins used to bind them. Urea- and phenol-formaldehyde are the most common resin binders in use. UF resin yields wood composite products for interior use, while PF, which is more expensive, is usually used in composite products intended for exterior use. Incremental improvements have been made by modifications to resins, methods of application, methods of producing feedstock, chemical additives for modification of feedstock, orientation of feedstock and pressing methods. However, the use of synthetic resins derived from petrochemicals remains as the main method of bonding.

One notable exception to the conventional processes of manufacturing is the Masonite process for thin hardboard, which differs from the conventional dry processes in that lignin, a component of wood, is used as a binder. No additional synthetic resins are added. However, the Masonite process is "wet," in that significant quantities of water are required to wash out water solubles, which interfere with the bonding process, from the fibre feedstock. The washing process also results in about 30% loss of raw material. Furthermore, the resulting product is limited in thickness to less than 6 mm and possesses screen marks on the backside. For these reasons, only a few wet process hardboard mills remain in operation today around the world.

One major drawback of conventional lignocellulosic composite products is their dimensional stability, measured by thickness swelling and linear expansion. Wood is hygroscopic in nature. It will absorb moisture and in a humid environment, it will swell. Conversely, wood will lose moisture and shrink in a dry environment. The fluctuation of humidity around the wood results in dimensional changes in accordance with the changes of the surrounding humidity while direct contact with water causes great dimensional changes. This dimensional change is undesirable, particularly in the case of lignocellulosic composite products, such as particleboard, fibreboard, oriented strand board and high pressure laminate, because these composite products are compressed into a higher density than their original form in order to develop interfacial adhesive bonding. Dimensional changes not only weaken the glue bond holding the products together, but also result in physical changes which compromise the integrity of the application for which the product is used; i.e. warping, cupping, buckling, bowing, splitting and cracking.

Significant improvement of the dimensional stability of composite products produced by conventional methods is very expensive, requiring additional quantities of resin, longer pressing times, higher temperature, tempering (addition of oil to hardboard) or chemical modification of fibre before pressing into the final product. Generally speaking, a highly dimensionally stable composite product from lignocellulosic material made with conventional methods is not commercially viable, except for certain specialized and limited applications.

One such product is high density composite. This product can be distinguished from lower density composites by its appearance, in which the visibility of fibres or particles is virtually eliminated, as the product takes on a plastic like appearance and texture, and improved physical properties, demonstrating lower thickness swelling than their lower density counterparts. Generally speaking, this type of product is achieved by using very high quantities of synthetic resins (generally, in the range of 30–60%) mixed with lignocellulosic materials, which are then consolidated under heat and high pressure to produce a very dense, and tough, water resistant product, with a density of around 1300–1500 kg/m3. However, the costs of production are extremely high due to the high resin content, and the use of Kraft paper impregnated with phenolic resin as a feedstock, resulting in limited use of these products.

One method of producing a high density composite with a thickness of 7.0 mm involves the assembly of 44 layers of resin impregnated Kraft paper (consisting of 1 overlay paper impregnated with melamine resin, 1 decor paper impregnated with melamine resin, 41 Kraft papers impregnated with phenol resin and 1 balance paper impregnated with melamine or phenol resin). When consolidated under heat and pressure, the resulting product retains a uniform, plastic like appearance. However, the laminated material has the disadvantage of low dimensional stability under varying climatic conditions. In particular, the plate expands or shrinks significantly more in the transverse direction than the longitudinal direction as a result of the orientation of fibres in the Kraft paper feedstock.

An improvement of the paper layering method of producing high density composite product is taught in the U.S. Pat. No. 4,503,115, entitled "Plate shaped moulded article and process for its preparation and use." In that patent, lignocellulose fibres are pressed together with thermosetting synthetic resins in the proportion 15 to 45% by weight to dry fibre, to a density between 900 to 1600 Kg/m3. The use of the fibre has the advantage of reducing costs, as the fibre is cheaper than Kraft paper, and improving the linear expansion properties, as the elimination of paper also eliminates the problem of differing dimensional variations resulting from the fibre orientation of the Kraft paper. However, the raw material costs of this method remain high, due to the high content of expensive resins, resulting in limited applications of the product.

A product that requires a high degree of dimensional stability, and particularly low levels of linear expansion, is laminate flooring. Laminate flooring is produced according to two general methods. The less expensive method of more recent development is the direct pressure lamination process (DPL) which involves pressing an abrasive resistant paper and melamine impregnated decorative paper on top of a fibre or particle coreboard with a melamine impregnated balance paper on the bottom of the coreboard. This laminate flooring is very popular. A second method to manufacture laminate flooring is by high pressure laminate (HPL). In the HPL process an abrasive resistant paper and melamine impregnated decorative paper and several sheets of phenol impregnated Kraft paper are assembled and pressed to a density of approximately 1,400 Kg/m3, for a relatively long time at a relatively high temperature. The resulting high pressure laminate is sanded on one side to improve its glue ability to the core board. The balance laminate is produced in a similar manner, being assembled with melamine and/or urea impregnated papers on the top and bottom with several sheets of phenol impregnated Kraft paper in the middle. The balance laminate is also sanded on one side to provide a suitable surface for gluing. The method to produce laminate flooring according to the HPL method is to assemble on the top a decorative HPL laminate (typically between 0.6–0.8 mm), in the middle, a core board of high density fiberboard or high density chipboard (density between 800 and 900 Kg/m3), and on the bottom, a balance laminate (typically between 0.6–0.8 mm). Laminate flooring by the HPL method is widely considered to be of better quality than the DPL method; however, because of the higher costs associated with the HPL method it is not as popular as the DPL method. According to a European consumer report, the best HDF core board has a thickness swelling of 7%.

In U.S. Pat. No. 5,017,319, EP 0,492,016, Canadian Patent 1,338,321 and EP 0,161,766, there is disclosed another process for making thermosetting resin adhesive and composite products from lignocellulosic material without the addition of synthetic resin. This process involves first using high pressure steam to decompose and hydrolyze the hemicellulose fraction, which accounts for 20–30% by weight of the lignocellulose, into low molecular weight water solubles. These water soluble materials are then utilized as a thermosetting adhesive to bond "in situ" the other components; i.e. the cellulose and lignin fractions of the lignocellulosic material under heat and pressure in a moulding operation to produce a reconstituted composite product. Since hemicellulose is one of the components of wood that is most hygroscopic and therefore most responsible for dimensional change in natural wood, its destruction renders the reconstituted product less hygroscopic and enhances dimensional stability. Furthermore, these patents also teach a secondary thermo-hydrolysis targeting and converting the cellulose fraction into water soluble resin material for the production of reconstituted composite products.

In addition, the low molecular weight water solubles derived from hemicellulose decomposition are able to permeate cell wall tissues and fill voids in the cellulose fibres, acting as a bulking agent. During the hot pressing operation, these water solubles polymerize, thermoset, and become water insoluble, thus eliminating or reducing water absorption. This bulking effect also enhances the dimensional stability of the reconstituted composite product. Thus, the water solubles, derived from hemicellulose decomposition, act as both a bonding and bulking agent to produce a moulded composite product with good mechanical strength and dimensional stability.

The lignin fraction, comprising 20–25% by weight of the lignocellulosic material, although decomposed and hydrolyzed by the high pressure steam into low molecular weight lignin and lignin decomposition products, which are water insoluble, is left in the hydrolyzed lignocellulosic material as a filler. The cellulose fibre (accounting for 45–50% of lignocellulose), which is not affected by the first steam treatment and which retains its physical integrity and is used as the backbone of the reconstituted composite product. The water soluble material functions as an adhesive, bonding "in situ" cellulose fibre and lignin together to yield a reconstituted composite product. The novelty of this process lies in the use of hemicellulose decomposition products as a binder, to improve physical properties of the composite products thus produced. The elimination of synthetic resin binders represents a significant breakthrough and improvement over conventional methods of manufacturing composite lignocellulosic products.

SUMMARY OF THE INVENTION

We have now discovered that the low molecular weight lignin and lignin decomposition products, which are encrusted on the cellulose fibres and which are not water-soluble, can be used to function as a bonding agent under high pressure moulding in the manufacture of high density composite products. It is believed that, under high pressure and heat during the moulding operation, the lignins become plasticized, melt and flow, in conjunction with the water solubles from hemicellulose hydrolysis and/or cellulose hydrolysis to develop an adhesive bond, thus further strengthening the physical properties. In addition, the densification of the product under high pressure, combined with the bulking effect of the hydrolyzed hemicellulose, eliminates virtually all remaining voids in the material, further enhancing the product's water resistance. Another possibility is that as the lignin decomposition products have undergone an autocondensation in which the function groups of the side chain, the phenolic hydroxyl groups and the reactive carbon atoms of the aromatic rings are involved to form bonding. The resulting composites, produced without the addition of any synthetic resins, are superior, particularly in dimensional stability, to those high density products manufactured according to conventional methods using large amounts of synthetic resins. In terms of economics, the production costs for the high density composite product are estimated to be 50–60% lower than that for conventionally produced high density composites. Further cost savings can be realized from use of non-woody alternative feedstocks, such as agricultural residues.

In accordance with one embodiment of the present invention there is provided a method of making a dimensionally stable composite product from lignocellulosic material comprising:

a) bringing the lignocellulosic material in divided form into contact with high pressure steam at a temperature high enough to decompose and hydrolyze hemicellulose and lignin contained in said lignocellulosic material without carbonization thereof;

b) maintaining the lignocellulosic material in contact with high pressure steam for a time sufficient only for the decomposition and hydrolysis of hemicellulose and lignin into low molecular weight, water-soluble resin material including (or comprising) pentose and hexose sugars, sugar polymers, furfural products, dehydrated carbohydrate, organic acids and low molecular weight lignins and other lignin decomposition products, with negligible degradation of cellulose;

c) drying the hydrolyzed lignocellulosic material;

d) forming the lignocellulosic material in comminuted form, e.g. as fiber or particles, into a mat or web;

e) compressing the said mat or web at a temperature and a pressure for a sufficient time to polymerise, cross-link, and thermoset the water-soluble resin material and lignin decomposition products into an adhesive which forms a bond "in situ" yielding a reconstituted composite product.

In the method according to the invention the hydrolyzed lignocellulosic material may be comminuted into fiber or particle form (e.g. before or after drying) or rendered into such form by explosive discharge from a vessel in which the lignocellulosic material has been subject to step a) and b).

In accordance with the present invention there is provided a method of making a dimensionally stable composite product from lignocellulosic material, comprising:

a) bringing the lignocellulosic material in divided form into contact with high pressure steam at a temperature high enough to decompose and hydrolyze hemicellulose and lignin contained in said lignocellulosic material without carbonization thereof;

b) maintaining the lignocellulosic material in contact with high pressure steam for a time sufficient only for the decomposition and hydrolysis of hemicellulose and lignin into low molecular weight, water-soluble resin material including (or comprising) pentose and hexose sugars, sugar polymers, furfural products, dehydrated carbohydrate and organic acids and low molecular weight lignins and other lignin decomposition products, with negligible degradation of cellulose;

c) drying the hydrolyzed lignocellulosic material;

d) forming a residue of the lignocellulosic material, in comminuted form, e.g. as fiber or particles, together with low molecular weight, water-soluble resin material including (or comprising) pentose and hexose sugars, sugar polymers, furfural products, dehydrated carbohydrate and organic acids derived from decomposition and hydrolysis of one or more of hemicellulose and cellulose, into a mat or web; and e) compressing the said mat or web at a temperature and a pressure for a sufficient time to polymerise, cross-link, and thermoset the water-soluble resin material into an adhesive which forms a bond "in situ" yielding a rigid reconstituted composite product, the low molecular weight lignins and other lignin decomposition products formed in step b) also contributing to forming the bond.

The pH of the residue may be adjusted before the thermosetting in step e).

In a first preferred aspect of the invention, water-soluble resin material in steps d) and e) is at least in part the water-soluble resin material produced in step b) and the mat or web also includes low molecular weight lignins and other lignin decomposition products formed in step b), such lignin decomposition products also contributing to forming the bond in step e). In this aspect of the invention it is not normally necessary to adjust the pH.

In a second preferred aspect of the invention the method further comprises, subsequent to step b) and prior to step c)

i) separating the water-soluble resin material derived from hemicellulose from the lignocellulosic material and concentrating the separated water-soluble resin material, by evaporation, into a thermosetting resin material suitable for use as a thermosetting waterproof resin adhesive;

ii) bringing the previously hydrolyzed lignocellulosic material, from which the water soluble resin material derived from hemicellulose has been removed, in contact with high pressure steam for a second time and for a time sufficient for the hydrolysis and decomposition of a major (or minor portion) of the cellulose into water soluble resin material including hexose and pentose sugars, sugar polymers, furfural, dehydrated carbohydrates, organic acids and other decomposition products; and iii) drying the residue of the hydrolyzed lignocellulose (the residue comprising mainly the water-soluble material from the cellulose hydrolysis, low molecular weight lignins and other lignin decomposition products and residue of cellulose fibre);

and wherein in steps d) and e) the water soluble resin material is that produced in step ii), the mat or web also including low molecular weight lignins and other lignin decomposition products formed in step b) and which also contribute to forming the bond.

An acid or acid catalyst may be used prior to step ii) to adjust the pH of the previously hydrolysed lignocellulosic material from which the water-soluble resin material derived from hemicellulose has been removed.

This invention thus relates to a process for making dimensionally stable reconstituted composite products from lignocellulosic material. By treating lignocellulose with high pressure steam to decompose and hydrolyse the hemicellulose and/or cellulose and lignin fractions of the lignocellulose and using those decomposition products as both a bonding and bulking agent, it converts, under heat and pressure in a moulding operation, the treated lignocellulose into moulded composite products such as panel boards and moulded articles, which are preferably stiff or rigid and are preferably of high density and fully thermoset. The composite products thus produced possess good physical and mechanical properties. Specifically, the dimensional stability in terms of the thickness swelling and linear expansion of panel boards such as fibreboards and particleboard can be minimized to very low levels when the panel boards are made in high density. The adhesive bond developed from thermosetting of the decomposition products of hemicellulose, cellulose and lignin is strong and stable, and resistant to boiling water and acid hydrolysis, and is free of formaldehyde emissions. Thus the reconstituted panel boards and moulded products are suitable for exterior and particularly for indoor applications. The absence of free formaldehyde emissions makes the product very suitable for interior applications. The manufacturing cost for the reconstituted products is significantly lower in comparison to the conventional process because expensive synthetic resin is not used.

EXAMPLE 1

This example demonstrates the pre-treatment of thermo-hydrolysis by high pressure steam of lignocellulose, followed by hot pressing and densification of the hydrolyzed lignocellulose into a moulded product.

Fresh spruce and hard maple planar shavings of about equal parts, containing approximately 22% moisture content were loosely loaded and packed into a pressure vessel. After sealing the vessel, high pressure steam of 447 psi (240 C) was introduced. The steam pressure was maintained at 447 psi for 90 seconds after which the outlet valve of the pressure vessel was instantaneously opened with an explosive discharge. The treated lignocellulose was collected in a bin through a cyclone that separated the material and steam. The hydrolyzed planar shavings were reduced into shredded fibers and fine particles, dark brown in colour with high moisture content. The water soluble resin material from hemicellulose hydrolysis contained about 18% sugars and a pH of 3.7. Similarly, the lignin fraction was also decomposed into lignin decomposition products of low molecular weight, which was water insoluble, and was encrusted on the surface of the cellulose fiber and particles. This hydrolyzed lignocellulose was dried to low moisture content of about 3%. The dried material was formed into a mat of predetermined size and weight that was then compression moulded into a single layer, homogeneous plate of 8 mm thickness. One mould temperature of 200 C was used with a press time of 20 minutes, which included a cooling time of 5 minutes. The pressing pressure ranged from 300 to 1050 psi, depending on the density of the panelboard pressed. A total of 5 plates (400×400×8 mm), of different densities were made and tested. Mechanical and physical properties were tested in accordance with ASTM D-1037. Additional tests for wet M.O.R. after 2 hour boil were performed in accordance with CAN0188.0M78—National standard for exterior grade wood based panel board. The plates were tested for free formaldehyde emissions and the result was 0.1 mg/m2h, according to the gas analysis method (norm PN-D-97013: 1999). This level of formaldehyde emissions classifies the product with an E0 rating which is the most stringent formaldehyde emissions standard for the wood based composite panel industry. This low level of free formaldehyde emissions will achieve the newly proposed European standard for "F-zero" or "formaldehyde free bonded" boards.

Test results are listed in Table 1. FIG. 1 clearly demonstrates the bonding capability of lignin in high density panel boards in which the internal bond strength exhibits an exponential increase. It is also very interesting to note that the colour of the higher density panel boards was dark brown and their plastic like texture were very similar to commercial high pressure laminate made with Kraft paper and phenolic resin. Lignins are believed to be the natural binder in lignocellulose and are chemically, phenolic in nature; therefore, it is possible, that when low molecular weight lignins and other lignin decomposition products perhaps, in conjunction with the water soluble resin material derived from hemicellulose hydrolysis, are cross-linked and thermoset, under heat and pressure, they develop an adhesive bond resembling the bond derived from a phenol-formaldehyde resin. Furthermore, the noticeable disappearance of individual cellulose fibre also suggests the cellulose fibre had been chemically and physically transformed and converted "in situ", during the moulding operation, first into water soluble resin material through thermal hydrolysis of cellulose, which then was thermoset into an adhesive bond fused into the matrix, contributing to the plastic like appearance and texture of the final composite product. It is believed that the cellulose hydrolysis was induced, during moulding operation, by the presence of water, which came from dehydration of pentose sugars in the water soluble resin material from hemicellulose hydrolysis, to yield furfural.

TABLE 1

Physical and mechanical properties of 8 mm spruce:maple plates

| Board No. | Density Kg/m3 | MOR (MPa) Dry | MOR (MPa) Boil 2 hr | MOE (MPa) | Internal Bond (MPa) | Swell 24 hr cold water soak (%) | L.E. (%) |
|---|---|---|---|---|---|---|---|
| A | 760 | 13.5 | 3.2 | 1400 | 0.35 | 15.6 | 0.24 |
| B | 920 | 26.7 | 12.6 | 3050 | 0.87 | 7.8 | 0.20 |
| C | 1060 | 45.3 | 21.7 | 4930 | 1.36 | 3.6 | 0.17 |
| D | 1210 | 60.2 | 32.3 | 7120 | 2.16 | 2.7 | 0.17 |
| E | 1380 | 82.6 | 44.3 | 9540 | >3.0 | <1.0 | 0.16 |

EXAMPLE 2

This example demonstrates the use of higher pressing temperature and/or longer pressing time to enhance the dimensional stability, particularly the thickness swelling, of lignocellulose panel boards. Fresh maple chips containing about 57% moisture content was treated with high pressure steam (198 C) for about 8 minutes. The treated maple chips were fed through a disc refiner under steam pressure of 6 bars to process the treated maple chips into fibers. The wet fibers were dried by hot air to a moisture content of 3–5%. The dry fibers were felted into a mat 400×400 mm. A total of 8 mats were made in an identical manner. These 8 mats were hot pressed at a platen temperature ranging from 160–220 degrees Celsius and pressed for a time ranging from 2–4 minutes. Target thickness was 8.0 mm and target density was 1,050 Kg/m3.

Test results are listed in Table 2. It is evident that mechanical properties were not significantly affected by the higher press temperature and long press times. However, the dimensional stability, i.e., thickness swelling and linear expansion, of the maple fiber boards are significantly reduced by the higher press temperature and longer press times.

TABLE 2

Physical and mechanical properties of 8 mm maple fiberboards

| Press Temp. (deg C.) | Press Time (min) | Density (Kg/m3) | M.O.R. (MPa) | M.O.E. (MPa) | Internal Bond (MPa) | 24 hr cold water swell (%) | 2 hr boil water swell (%) | L.E. (%) |
|---|---|---|---|---|---|---|---|---|
| 160 | 2 | 1030 | 48.6 | 5460 | 1.7 | 9.6 | 20.2 | 0.19 |
| 160 | 4 | 1050 | 52.2 | 5840 | 1.9 | 7.4 | 16.6 | 0.18 |
| 180 | 2 | 1040 | 48.6 | 5570 | 1.9 | 8.5 | 15.2 | 0.19 |
| 180 | 4 | 1070 | 53.6 | 6020 | 2.1 | 8.0 | 10.7 | 0.17 |
| 200 | 2 | 1060 | 54.3 | 6330 | 2.4 | 6.3 | 13.5 | 0.17 |
| 200 | 4 | 1070 | 54.8 | 6480 | 2.6 | 5.5 | 10.2 | 0.16 |
| 220 | 2 | 1050 | 54.6 | 6350 | 2.6 | 4.2 | 10.8 | 0.15 |
| 220 | 4 | 1070 | 55.2 | 6320 | 2.7 | 2.7 | 9.2 | 0.14 |

EXAMPLE 3

This example illustrates the flexibility of the inventive process for making preformed semi-rigid, partially cured sheets in the thickness range of 6 to 12 mm to a density between 550 to 900 Kg/m3 for future processing into high density composite plates. The preformed sheets of fibreboard can be effectively and economically produced on a continuous press. The semi-rigid sheets are easily handled in a subsequent operation to yield a final composite product, or readily packed for shipping or storage, in contrast to the soft and fragile mats used in conventional processes.

Mixed beech and pine wood chips at a ratio of 65:35, by volume, were continuously loaded into a digester (chip cooker) at a commercial medium density fiberboard plant. The chips were cooked under a steam pressure of 12 bar (190 C) for about 10 minutes and then extruded continuously through a pressurized refiner with counter-rotating disc plates that comminuted the steam treated wood chips into fibers and fiber bundles. The fibers were dried in a flash tube dryer to a moisture content of 5%. The dried fibers were conveyed to a forming station and felted into a continuous fiber mat, which was pre-pressed to remove excess air, and pressed in a continuous press under heat (180 C maximum temperature) and pressure to transform the soft mat into a semi rigid and rigid panel of a pre-determined thickness and density. Thickness ranged from 6 to 12 mm, and density ranged from 520 to 900 Kg/m3. The consolidation of the preformed sheets was due to the adhesive bond developed by the water soluble resin material which was derived from the hemicellulose hydrolysis during the steam treatment of the wood chips. These preformed sheets were cut to size, for either immediate processing into final composite products, or to be packed for storage and/or shipping for processing at a later date. These preformed sheets had a very long shelf-life. After 2 years of storage no evidence of degradation was found in the final products. This unique characteristic is one of the most important benefits of the present invention in both technological and economical aspects.

EXAMPLE 4

This example shows the densification of preformed sheets into high density composite panelboards. The preformed rigid MDF sheet, 10 mm thick, 700 kg/m3 density, containing less than 2% moisture content was, in a second operation, compressed into high density fiberboard. Two of the preformed MDF sheets were placed in a single daylight press. They were pressed under a specific pressure of 1,100 psi and a platen temperature of 165 Celsius for 25 minutes. At the end of the heating period the platen temperature was lowered to about 70 Celsius in about 3 minutes. At this time the pressure was reduced to 0 and the press was opened. The average density of this high density 10 mm fiber board was 1,370 Kg/m3. Bending strength (MOR) was 87.5 MPa, MOE: 9,740 MPa, Internal Bond: >3.5 MPa, thickness swelling after 24 hour soaking: 1–2%, and after 2 hour boiling: 4–6%, linear expansion in the length of 0.17% and linear expansion in the width of 0.16%.

EXAMPLE 5

This example demonstrates the manufacture of high density laminate flooring board from preformed MDF sheets at a commercial manufacturing facility. Preformed sheets, 6 mm in thickness, with a density of 680 Kg/m3 were assembled in the following manner. From the top the stratification of the assembly was 1) a melamine impregnated overlay protective paper 2) a melamine impregnated decorative paper 3) two preformed MDF sheets panels, 4) a melamine impregnated balance paper. The total assembly was placed between two stainless steel caul plates and placed in the press for densification. The same pressing conditions were used as in Example 4 with the exception that the press heating time was 35 minutes, in order to improve the dimensional stability of the final product. The panels, after pressing and cooling, were cut to a size of a 195×1305 mm and profiled with a tongue and groove for laminate flooring. This 5.9 mm thick laminated flooring board had a density of 1,410 Kg/m3, bending strength (MOR): 102 MPa, MOE: 12,470 MP, Internal bond >3.5 MPa, surface strength >3.5 MPa, 24 hour cold water soaking (center): 0.0%, edge swelling: 2.8%, linear expansion in the length of 0.15% and linear expansion in the width of 0.14%. The extended press time under heat further reduced the thickness swelling. The best laminate flooring board on the market today claims a core board center swell of 7.0% after 24 hour cold water soaking.

EXAMPLE 6

This example demonstrates a method to make laminated flooring board with superior mechanical strength and dimensional stability, i.e., virtually no thickness swelling after 24 hours immersion in cold water.

The raw material preparation and production of the preformed MDF sheets was identical to example 2 however, the preformed MDF sheet had a thickness of 12 mm and a density of 800 Kg/m3. The preformed MDF sheet was assembled with melamine resin impregnated papers. From the top the stratification of the assembly was 1) a melamine impregnated overlay protective paper 2) a melamine impregnated decorative papers 3) a preformed MDF sheet or panel as coreboard, 4) a bottom melamine impregnated paper. A stainless steel caul plate with wood grain etched structure was placed on top of the assembly, and a glossy smooth caul plate was placed on the bottom of the assembly. The entire assembly was carried into a single opening press and pressed under a specific pressure of 1,100 psi or 800 N/cm2 with a platen temperature of 165 deg C. The heating time was 20 minutes at 165 degrees Celsius, and then the platen temperature was reduced to 65 degrees Celsius in about 3 minutes. The pressure was reduced to 0 and the press was opened. The consolidated panel of 6.9 mm, and 1410 kg/m3 density, was cut to a size of a 195×1305 mm and profiled with an interlocking tongue and groove as laminated flooring board.

The mechanical and physical properties of the 6.9 mm laminated flooring board were tested in accordance with EN 13329, DIN EN 311, 319, 310, DIN EN 438–2.18 and ISO 2813. Test results are listed in Table 3.

TABLE 3

Physical and mechanical properties of 6.9 mm laminated flooring board

| Test | Standard | Unit | Result |
|---|---|---|---|
| Thickness | EN 13329 | Mm | 6.9 |
| Surface tightness | Werkstandard PV 054 | Grade | 5 |
| Hardness | Werkstandard PV 010 | Grade | 1 |
| Resistance against cigarette | DIN EN 438-2.18 | Grade | 5 |
| Impact resistance (small ball) | EN 13329 | N | 12 |
| Impact resistance (big ball) | EN 13329 | mm | 1900 |
| Abrasion resistance | EN 13329 | Umdr. | 4000 |
| Edge swelling | EN 13329 | % | 1.89 |
| Edge swelling after redry | EN 13329 | % | 0.06 |
| Linear expansion length | EN 13329 | % | 0.15 |
| Linear expansion width | EN 13329 | % | 0.14 |
| Linear contraction length | EN 13329 | % | −0.04 |
| Linear contraction width | EN 13329 | % | −0.06 |
| Surface Soundness | DIN EN 311 | N/mm2 | >4 |
| Internal Bond | DIN EN 311 | N/mm2 | >4 |
| Modulus of Rupture | DIN EN 311 | N/mm2 | 91.35 |
| Modulus of Elasticity | DIN EN 311 | N/mm2 | 12000 |
| Gloss (60 deg) | ISO 2813 | | 19.8 |

EXAMPLE 7

This example demonstrates the advantages of using preformed low density fiberboard (LDF) sheets for the production of three-dimensional doorskins in a separate operation. The preformed sheets were produced at a commercial fiberboard plant as described in Example 3. The preformed sheets of LDF were 6.3 mm thick with a density of 550 Kg/m3 and had a moisture content of 2–3%. The LDF sheets were packed at the MDF plant and shipped to the doorskin factory for densification into three dimensional doorskins. The semi-rigid preformed sheets were first sprayed with water at a rate of 30 gr/m2 on both sides of the preformed sheet. After water spraying, the preformed sheets were positioned directly in the moulding press for densification and thermosetting to produce a rigid doorskin. The moulding temperature was 185 C, densification pressure of 500 psi (54.5 Kg/cm2) and a press time of 75 seconds. The moulded doorskin was 3.2 mm thick with a density of 1040 Kg/m3. MOR:47 MPa, MOE:6.5 GPa, IB:1.58 MPa, thickness swelling after 24 cold water soak 14.3%. The surface of the doorskin was tight and smooth. The moulded doorskin did not show any stress marks or weak spots along the contour or deep profile area indicating the good mouldability and flow property of the preformed sheets when pressed in the mould under heat and pressure. Here again, the presence of the decomposed lignin acting as lubricant in the preformed LDF sheet improved and promote the mouldability of the preformed sheet.

EXAMPLE 8

This example illustrates the use of agricultural by-products of rice husks and sugar cane bagasse for the production of high density panel board.

Rice husks with a moisture content of 8–9% and fresh sugar cane bagasse containing 40–45% M.C. were mixed in equal portion based on the oven dry weight and treated with high pressure steam of 475 psi (240 C) for 60 seconds. The treated mixture was instantly expelled from the treating vessel with an explosive discharge which rendered the lignocellulosic material in fine powdery particles. The treated material was dried to about 2% moisture content and formed into a mat of 400×400 mm. The mat was compression moulded under a pressure of 1200 psi (83 Kg/cm2), a platen temperature of 165 C, a moulding time of 25 minutes (including a cooling time of 5 minutes), into a high density plate of 8 mm thickness with a density of 1460 Kg/m3. This moulded plate was very hard with a MOR: 52.2 MPa, MOE: 6.3 GPa, IB: >3.5 MPa, Hardness: >40 KN (Since rice husk contained more than 20% by weight of silica, this plate was indeed very hard), thickness swelling <1.0% and a linear expansion of 0.18%, and 0.19 respectively with regard to direction of the plate thus indicating the isotropic nature of the plate. The linear expansion was measure on a sample first oven dried for two hours and measured again after immersion in cold water for 24 hours. This is a quick test method according to the norm CAN3.0188.3-M82, Exterior Bond Mat Formed Wood Particleboard, which measures the linear expansion from changes in relative humidity from 50% to 90%.

EXAMPLE 9

This example illustrates the conversion of the cellulose fraction into water soluble resin material for the production of reconstituted composite products.

Mixed beech and pine wood chips, which had been steam treated at 12 bar pressure for 10 minutes, as described in Example 3, (i.e., hydrolyzed lignocellulosic material) were eluted once with hot water to extract a major portion of the water soluble resin material. Subsequently the chips were sprayed with a solution of dilute sulphuric acid that contained about 0.8% sulphuric acid, by weight, to the chips. The acid treated chips were steam treated for a second time at 15 bar pressure for 12 minutes to convert a major portion of the cellulose into water soluble resin material. At the end of the steam treatment, the steam pressure was suddenly released and the hydrolyzed chips were expelled from the treating vessel with an explosive discharge that reduced the wood chips into fine particulates. The hydrolyzed material was wet, grey in colour and had a consistency similar to pot soil. The material consisted of lignin decomposition products, water soluble resin material, and residue of cellulose fiber. Prior to drying the material, a solution of sodium hydroxide was added to the wet hydrolyzed material to adjust the pH to about 3.5. After drying the hydrolyzed material had a moisture content of 3–5%, and was ready as a feed stock for the production of reconstituted composite product. A laminate flooring board with a thickness of 6.9 mm was fabricated following the same procedure as described in Example 6. The physical properties of this laminated flooring board was very comparable to that of laminated flooring boards that were produced from beech and pine wood chips which were thermo hydrolyzed only once. Interestingly, an edge swelling after 24 hours cold water soaking of 1.3% versus 1.9%, indicates an improved dimensional stability that could result from the cellulose hydrolysis and the high content of lignin decomposition products in this laminate flooring board.

The invention claimed is:

1. A method of making a dimensionally stable composite product from lignocellulosic material, comprising:

a) bringing the lignocellulosic material in divided form into contact with high pressure steam at a temperature high enough to decompose and hydrolyze hemicellulose and lignin contained in said lignocellulosic material without carbonization thereof;

b) maintaining the lignocellulosic material in contact with high pressure steam for a time sufficient only for the decomposition and hydrolysis of hemicellulose and lignin into low molecular weight, water-soluble resin material including pentose and hexose sugars, sugar polymers, furfural products, dehydrated carbohydrate and organic acids and low molecular weight lignins and other lignin decomposition products, with negligible degradation of cellulose;

c) drying the hydrolyzed lignocellulosic material;

d) forming the residue of the lignocellulosic material, in comminuted form, and including low molecular weight lignins and other lignin decomposition products formed in step b), together with low molecular weight, water-soluble resin material including pentose and hexose sugars, sugar polymers, furfural products, dehydrated carbohydrate and organic acids derived from decomposition and hydrolysis of one or more of hemicellulose and cellulose, into a mat or web; and e) compressing the said mat or web at a temperature and a pressure for a sufficient time to polymerise, cross-link, and thermoset the water-soluble resin material and lignin decomposition products into an adhesive which forms a bond "in situ" yielding a reconstituted composite product.

2. A method according to claim 1, wherein the water-soluble resin material in steps d) and e) is at lest in part the water-soluble resin material produced in step b).

3. A method according to claim 1, further comprising, subsequent to step b) and prior to step c)

i) separating the water-soluble resin material derived from hemicellulose from the lignocellulosic material and concentrating the separated water-soluble resin material, by evaporation, into a thermosetting resin material suitable for use as a thermosetting water-proof resin adhesive;

ii) bringing the previously hydrolyzed lignocellulosic material, from which the water soluble resin material derived from hemicellulose has been removed, in contact with high pressure steam for a second time and for a time sufficient for the hydrolysis and decomposition of a portion of the cellulose into water soluble resin material including hexose and pentose sugars, sugar polymers, furfural, dehydrated carbohydrates, organic acids and other decomposition products; and iii) drying the residue of the hydrolyzed lignocellulose; and wherein in steps d) and e) the water soluble resin material is that produced in step ii).

4. The method according to claim 1, wherein the steam temperature for hydrolyzing and decomposing the hemicellulose and lignin of the lignocellulosic material in steps a) and b) is in the range of 120 to 280 C.

5. The method according to claim 1, wherein the temperature to thermoset the water soluble resin material into the bond in step e) is in the range of 120 to 280 C.

6. A method according to claim 1, wherein, subsequent to step d) the mat or web is compressed at a temperature and a pressure to partially thermoset the water soluble resin material to form a consolidated coherent preformed sheet or panel board that will result on further compression in step e) in the formation of the rigid reconstituted composite product of high density.

7. A method according to claim 6, wherein, to produce the preformed sheet or panel board, the temperature at which the web or mat is compressed is maintained at 120 to 250 C, and the preformed sheet or panel board has a density of less than 1400 Kg/m3.

8. A method according to claim 6, wherein step e) comprises:

e1) placing the preformed panel board or sheet into a press with a platen temperature at 120 C or higher;

e2) closing the press and maintaining a pressure sufficient enough to attain the desired density and or a time sufficient to thermoset the adhesive bond;

e3) releasing the pressure; and e4) opening the press and removing the densified composite.

9. The method according to claim 8, wherein subsequent to sub-step e2) and prior to releasing the pressure in sub-step e3) the platen temperature is cooled to below 90 C.

10. The method according to claim 8, wherein the density of the densified composite does not exceed 1500 Kg/m3.

11. The method according to claim 6, wherein a stack of the preformed sheets or panel boards are compressed in step e) to produce the reconstituted composite product.

12. The method according to claim 6, wherein preformed sheet or panel boards produced in accordance with any of claims 6 to 11 are assembled with decorative sheets on opposite surfaces and compressed in step e) to produce the reconstituted composite product.

13. An E0 classification composite panel product or formaldehyde-free composite produced by a method according to claim 1.

14. A method of making a composite product from lignocellulosic material, comprising:

a) bringing the lignocellulosic material in divided form into contact with high pressure steam at a temperature high enough to decompose and hydrolyse hemicellulose and lignin contained in said lignocellulosic material without carbonization thereof;

b) maintaining the lignocellyulosic material in contact of hemicellulose and lignin into low molecular weight, water-soluble resin material including pentose and hexose sugars, sugar polymers, furfural products, dehydrated carbohydrate and organic acids and low molecular weight lignins and other lignin decomposition products, with negligible degradation of cellulose;

c) drying the hydrolyzed lignocellulosic material;

d) forming the residue of the lignocellulosic material, in comminuted form, and including low molecular weight lignins and other lignin decomposition products formed in step b), together with low molecular weight, water-soluble resin material including pentose and hexose sugars, sugar polymers, furfural products, dehydrated carbohydrate and organic acids derived from decomposition and hydrolysis of one or more of hemicellulose and cellulose, into a mat or web; and e) compressing the said mat or web at a temperature and a pressure for a sufficient time to polymerise, cross-link, and thermoset at least the water-soluble resin material into an adhesive which forms a bond "in situ" yielding a reconstituted composite product, lignin decomposition products not forming the bond being available for further bonding on further compressing of the product at a temperature and pressure and for a sufficient time to polymerise, cross-link and thermoset such products.

* * * * *